US006615692B2

(12) United States Patent
Hu

(10) Patent No.: US 6,615,692 B2
(45) Date of Patent: Sep. 9, 2003

(54) VIBRATION-ABSORBING TOOL HANDLE COVER

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 0 days.

(21) Appl. No.: 10/113,264

(22) Filed: Apr. 1, 2002

(65) Prior Publication Data

US 2002/0144573 A1 Oct. 10, 2002

(30) Foreign Application Priority Data

Apr. 9, 2001 (TW) ..... 90205577 U
Apr. 9, 2001 (TW) ..... 90205578 U

(51) Int. Cl.[7] ..... B25G 1/01
(52) U.S. Cl. ..... 81/22; 81/489
(58) Field of Search ..... 81/20, 22, 489; 16/DIG. 12

(56) References Cited

U.S. PATENT DOCUMENTS 811,390 A * 1/1906 Foreman ..... 81/489
6,170,362 B1 * 1/2001 Chen ..... 81/22
6,220,128 B1 * 4/2001 Hu ..... 81/489
6,336,380 B1 * 1/2002 Lin ..... 81/22

FOREIGN PATENT DOCUMENTS

DE 10113368 A1 * 10/2001 ..... B25D/01/12

* cited by examiner

*Primary Examiner*—Lee D. Wilson
*Assistant Examiner*—David B. Thomas
(74) *Attorney, Agent, or Firm*—Alan D. Kamrath; Rider Bennett, LLP.

(57) ABSTRACT

A handle cover is made of soft material and includes a central longitudinal compartment for receiving a handle of a tool. A plurality of first holes and a plurality of second holes are defined in an upper portion of the handle cover. The first holes and the second holes are alternately disposed along a longitudinal direction of the handle cover with each first hole extending in a direction transverse to the longitudinal direction of the handle cover and having an opening in a left side of the upper portion of the handle cover and with each second hole extending in the direction transverse to the longitudinal direction of the handle cover and having an opening in a right side of the upper portion of the handle cover. The lower portion of the handle cover has an identical arrangement.

20 Claims, 14 Drawing Sheets

VIBRATION-ABSORBING TOOL HANDLE COVER

BACKGROUND OF THE INVENTION

1. Field of the Invention

The present invention relates to a vibration-absorbing handle cover for a hand tool such as a hammer.

2. Description of the Related Art

Hammers generally have a wooden or plastic handle with poor vibration-absorbing capability. When hammering, vibrations occur along a vertical direction of the hammer. The vibrations are greater when the hammered object is more rigid. Thus, the four fingers other than the thumb as well as the area between the thumb and the index finger of the user's hand are often numb with or even injured by the vertical vibrations generated by the reactive force as a result of hammering. U.S. Pat. No. 6,170,362 to Chen issued on Jan. 9, 2001 discloses a shockproof structure of the handle cover of a hand tool. The handle cover is made of soft, elastic material and comprises an inserting portion for receiving a handle of a hand tool. Vents are provided at sides of upper and lower portions of the handle cover. Each vent has a certain depth within the handle cover without penetrating the handle cover. However, the handle cover could not absorb all of the vibrations generated as result of hammering. At best, the handle cover may absorb a part of the vibrations to an extent that the remaining vibrations transmitted to the user's hand are harmless to the user. However, two sides of the handle cover could deform in an asymmetric manner when the user holds the handle cover with a large force. Further, the two sides of the handle cover have different softness, as the vents are asymmetrically defined in a side of the handle cover without penetrating the handle cover. Further, no vibration-absorbing function is provided if the user holds the handle cover in a reverse direction. Further, the vents are not uniform in dimensions such that the vents could not deform by the same magnitude. The non-uniform deformation of the handle cover during operation adversely affects the vibration-absorbing function. The user would feel uncomfortable and non-uniform absorption of vibrations occurs, which would lead the user to injury.

U.S. Pat. No. 811,390 to Foreman issued on Jan. 30, 1906 discloses a handle having a plurality of annularly disposed axially extending channels in an outer periphery thereof for absorbing vibrations. However, the shock-absorbing effect is poor. U.S. Pat. No. 4,738,166 to Yamaguchi issued on Apr. 19, 1988 discloses a helve of a hammer comprising upper and lower axially extending passages and a plurality of openings on two sides of the helve. However, the openings are not communicated with the axially extending passages, and the shock-absorbing effect is poor.

U.S. Pat. No. 6,220,128 to Hu issued on Apr. 24, 2001 discloses a shock-absorbing handle of a hand impact tool comprising upper and lower axial passages and several rows of openings communicated with the axial passages. The shock-absorbing effect is improved. However, the hammer tends to slip from the user's hand during hammering. This is owing to the fact that two ends of each axial passage are communicated with outside. Further, manufacture of this handle requires a complicated, costly mold in which a difficult process of drawing a bar for forming the respective axial passage must be proceeded after injection molding.

SUMMARY OF THE INVENTION

An object of the present invention is to provide a vibration-absorbing handle cover for a hand tool. The handle cover is capable of providing a more uniform vibration-absorbing effect during operation. It is achieved by means of removing the material from an upper portion and a lower portion of the handle cover, thereby reducing the amount of material that transmits the vibrations. The shock-absorbing handle cover can be manufactured by simple, inexpensive molds in an easier manner.

In accordance with a first aspect of the invention, a handle cover is made of soft material and includes a central longitudinal compartment for receiving a handle of a tool. A plurality of first holes and a plurality of second holes are defined in an upper portion of the handle cover. The first holes and the second holes are alternately disposed along a longitudinal direction of the handle cover with each first hole extending in a direction transverse to the longitudinal direction of the handle cover and having an opening in a left side of the upper portion of the handle cover and with each second hole extending in the direction transverse to the longitudinal direction of the handle cover and having an opening in a right side of the upper portion of the handle cover. Each first hole is delimited by a first end wall on the right side of the upper portion of the handle cover. Each second hole is delimited by a second end wall on the left side of the upper portion of the handle cover.

A plurality of third holes and a plurality of fourth holes are defined in a lower portion of the handle cover. The third holes and the fourth holes are alternately disposed along the longitudinal direction of the handle cover with each third hole extending in the direction transverse to the longitudinal direction of the handle cover and having an opening in a left side of the lower portion of the handle cover and with each fourth hole extending in the direction transverse to the longitudinal direction of the handle cover and having an opening in a right side of the lower portion of the handle cover. Each third hole is delimited by a third end wall on the right side of the lower portion of the handle cover. Each fourth hole is delimited by a fourth end wall on the left side of the lower portion of the handle cover.

By such an arrangement, the material for transmitting vibrations along the vertical direction is removed to an extent that the remaining vibrations transmitted to the user's hand is harmless. The holes allow the handle cover to deform during hammering. The user may firmly grasp the handle cover without the risk of slip due to the balanced arrangement of the holes.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
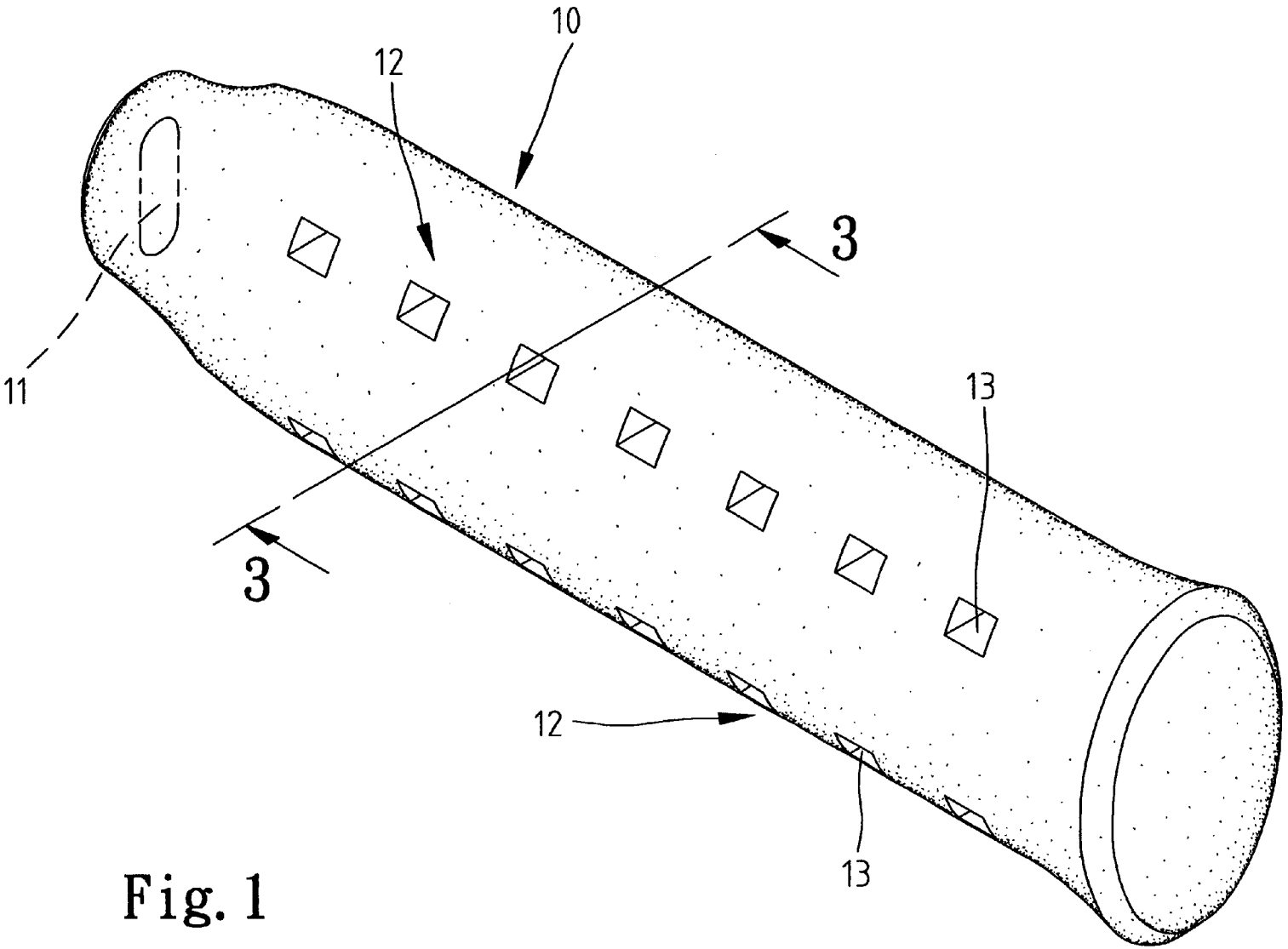
FIG. 1 is a perspective view of a first embodiment of a handle cover in accordance with the present invention.
Figure 2:
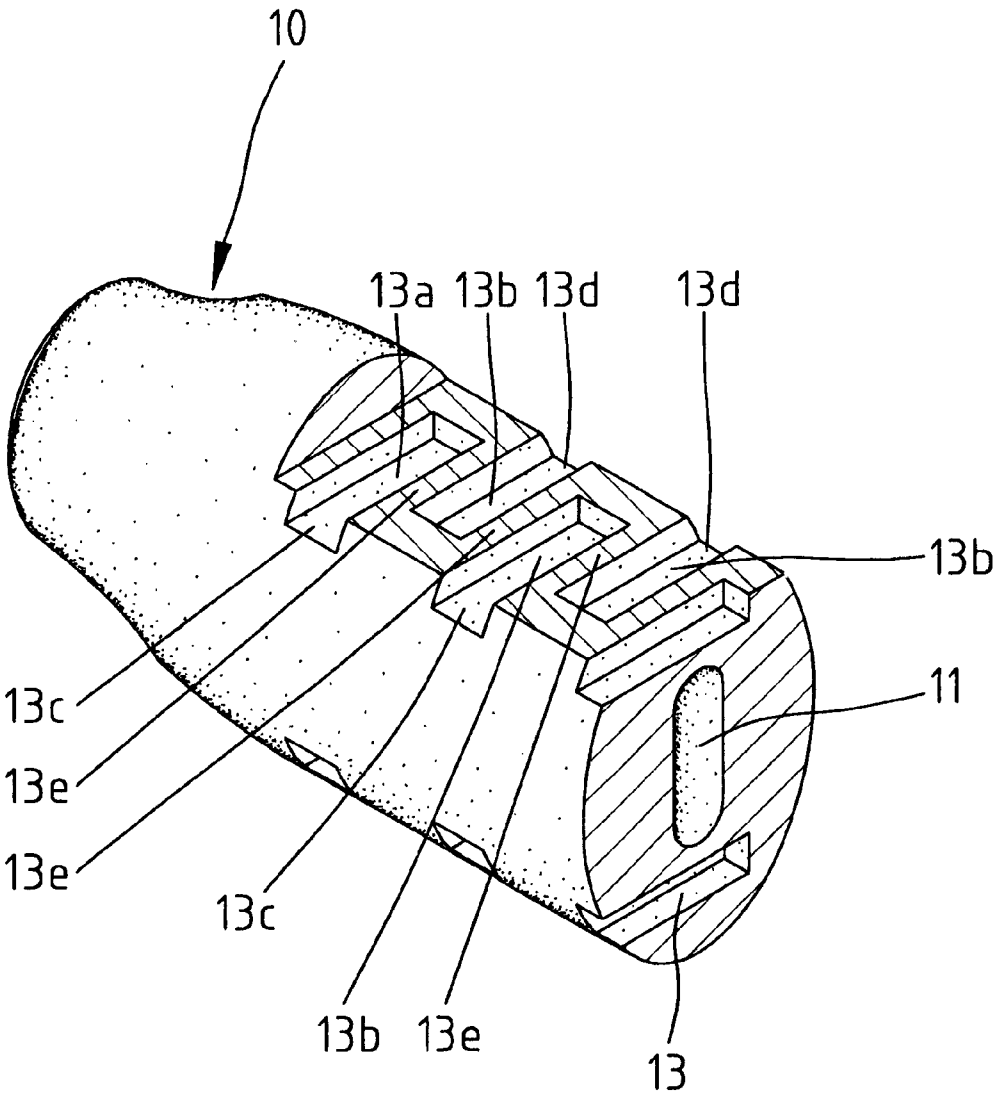
FIG. 2 is a perspective view, partly cutaway, of the handle cover in accordance with the present invention.
Figure 3:
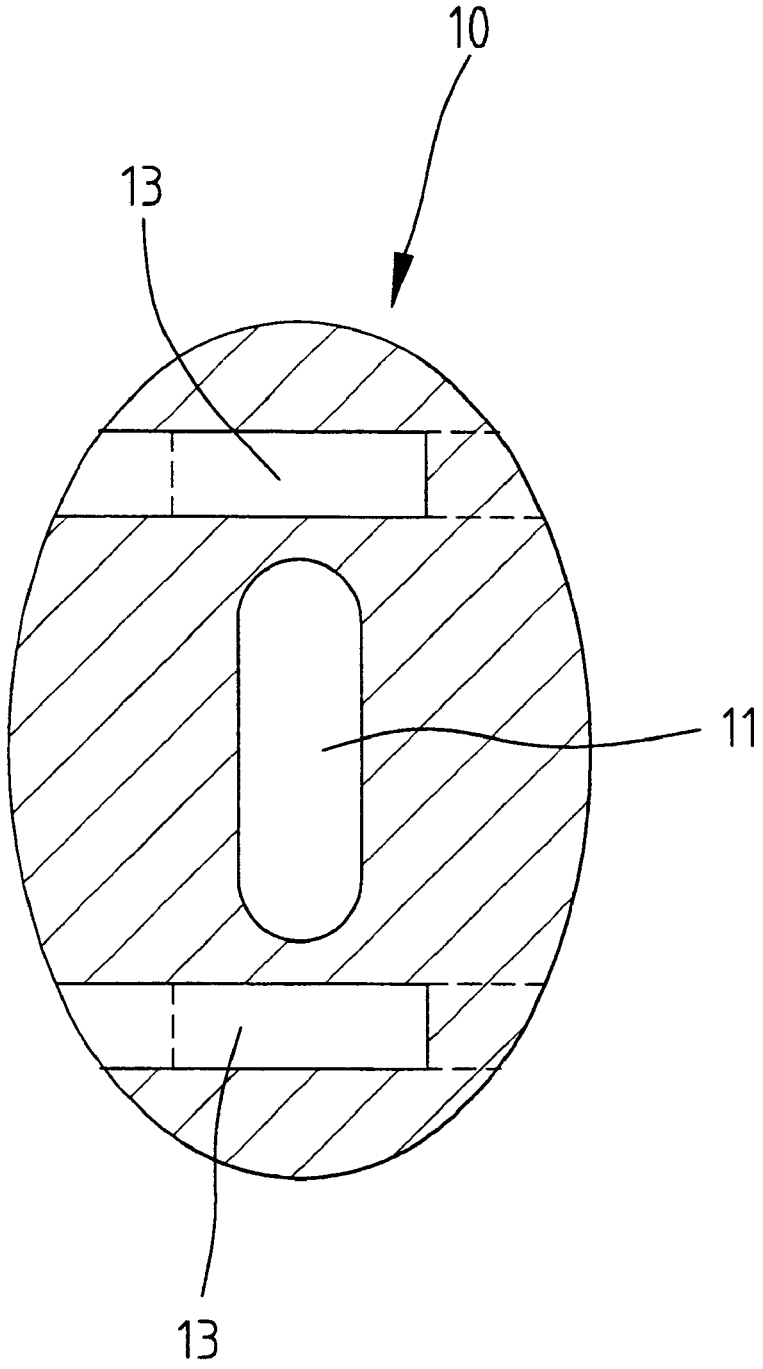
FIG. 3 is a sectional view taken along plane 3—3 in FIG. 1.
Figure 4:
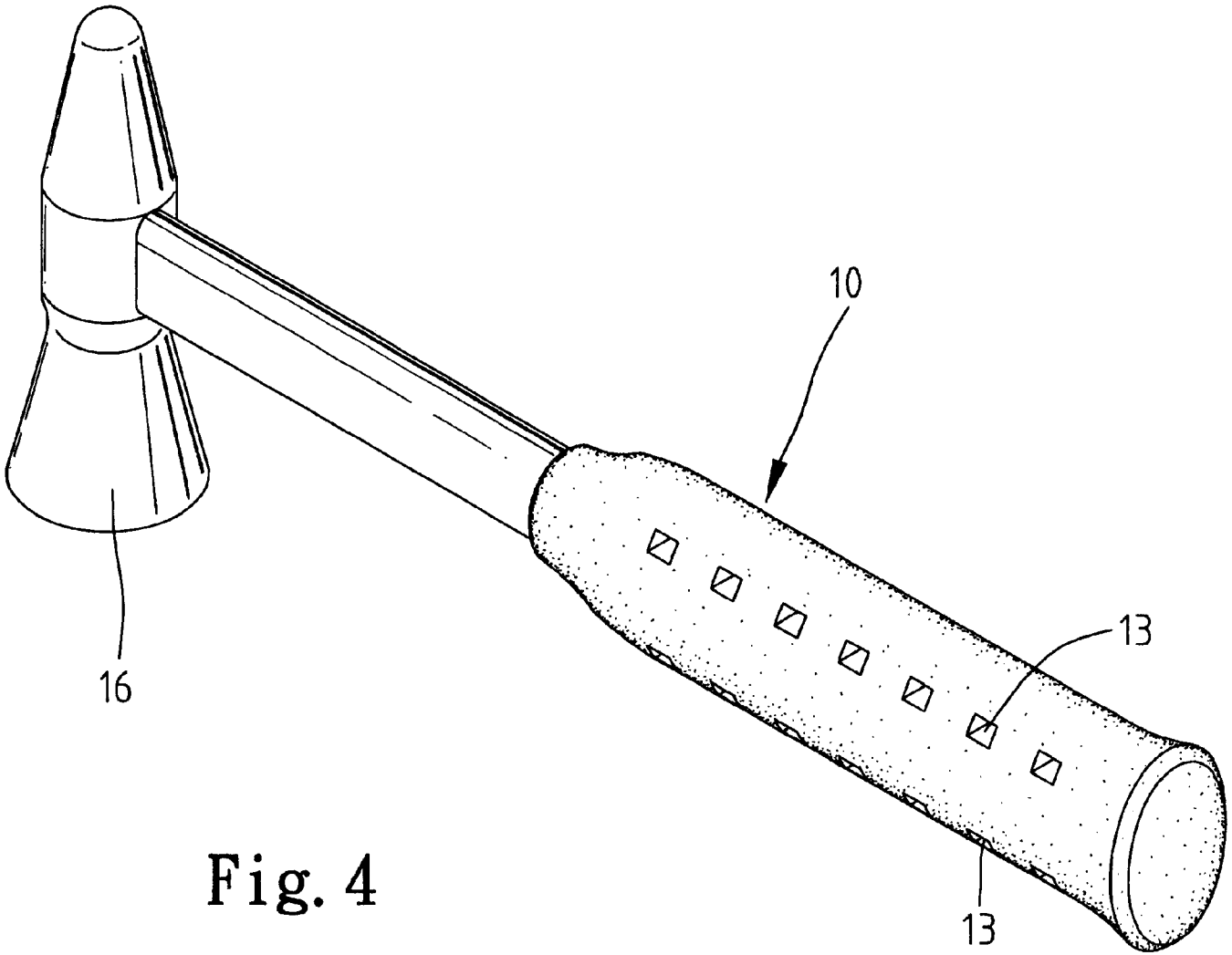
FIG. 4 is a perspective view of a hammer with the handle cover in FIG. 1.

Referring to FIGS. 1 through 3, a handle cover 10 in accordance with the present invention is made of soft material and generally comprises a central longitudinal compartment 11 for receiving a handle (not shown) of a tool, e.g., a hammer 16 (FIG. 4). A plurality of first holes 13*a* and a plurality of second holes 13*b* are alternately disposed on an upper portion of the handle cover 10 along a longitudinal direction of the handle cover 10. Each first hole 13*a* is a blind hole extending in a direction transverse to the longitudinal direction of the handle cover 10 and having an opening 13*c* that is located in, e.g., a left side of the handle cover 10. Each second hole 13*b* is also a blind hole extending in the direction transverse to the longitudinal direction of the handle cover 10 and having an opening 13*d* that is located in, e.g., a right side of the handle cover 10. As can be seen in FIG. 2, each first hole 13*a* is spaced from the second hole 13*b* adjacent thereto by a separation wall 13*e*. When hammering, the air in each hole 13*a*, 13*b* exits the handle cover 10 through the opening 13*c*, 13*d*, and the handle cover 10 deforms. Then, ambient air enters each hole 13*a*, 13*b* through the opening 13*c*, 13*d*, and the handle cover 10 restores its shape. The lower portion of the handle cover 10 has an identical arrangement and is therefore not described in detail to avoid redundancy. Nevertheless, it is noted that the holes 13 in the lower portion of the handle cover 10 are preferably symmetric to the holes 13*a* and 13*b* with respect to the central longitudinal compartment 11.

By such an arrangement, the holes 13*a* and 13*b* are disposed on the upper portion of the handle cover 10 in a more balanced manner with respect to a longitudinal axis of the handle cover 10. Namely, the left side of the handle cover 10 and the right side of the handle cover 10 are balanced in softness.

Referring to FIG. 4, the handle cover 10 can be attached to a hammer 16. The holes 13, 13*a*, and 13*b* allow the handle cover 10 to deform during hammering. Thus, the user may firmly grasp the handle cover 10 without the risk of slip even if the hammer swung by the user is relatively heavy, as the handle cover 10 would not be too rigid to hold during vibrations of generated as a result of the reactive force transmitted through the hammer. Further, if the hammer is heavy, it has a low vibrating frequency, which means that the handle cover 10 needs not to have a high vibration-absorbing capability. Thus, the handle cover 10 in accordance with the present invention avoids slip during operation of the heavy hammer while providing the vibration-absorbing function. Most part of the vibrations generated as a result of hammering is absorbed by the handle cover 10. The remaining amount of vibrations transmitted to the user's hand is harmless.

It is noted that the vibration-absorbing function of the handle cover 10 is achieved by means of removing a part of the material for transmitting vibrations such that the remaining vibrations transmitted from the hammer to the user's hand through the handle cover 10 is harmless to the user's hand. Further, the left side of the upper portion of the handle cover 10 and the right side of the upper portion of the handle cover 10 are balanced in softness by means of alternately forming the first holes 13*a* and the second holes 13*b* along the longitudinal direction of the handle cover 10. The lower portion of the handle cover 10 has an identical arrangement.

The number of the holes 13, 13*a*, and 13*b* are determined by the softness of the handle cover 10. Namely, more holes 13, 13*a*, and 13*b* are provided on the handle cover 10 when the handle cover 10 is made of a more rigid material, thereby increasing the deformability of the handle cover 10 for absorbing the vibrations generated as a result of hammering. By contrast, less holes 13, 13*a*, and 13*b* can be provided if the handle cover 10 is made of a softer material for achieving the vibration-absorbing function.

A left mold (not shown) and a right mold (not shown) can be used to manufacture the handle cover 10 in accordance with the present invention. The left mold and the right mold are disposed face to face and partially intersect each other, and molten plastic material is poured into the left mold and the right mold. After hardening of the plastic material, the left mold and the right mold are removed, and a handle cover 10 is formed. The troublesome, costly manufacture of the shock-absorbing handle of the U.S. Pat. No. 6,220,128 involving difficult drawing of a bar form forming the respective axial passage is avoided.

It is noted that the handle cover 10 in accordance with the present invention can be used with any hand tool for hammering, providing an excellent vibration-absorbing function as well as easy-to-grip advantage.

Figure 5:
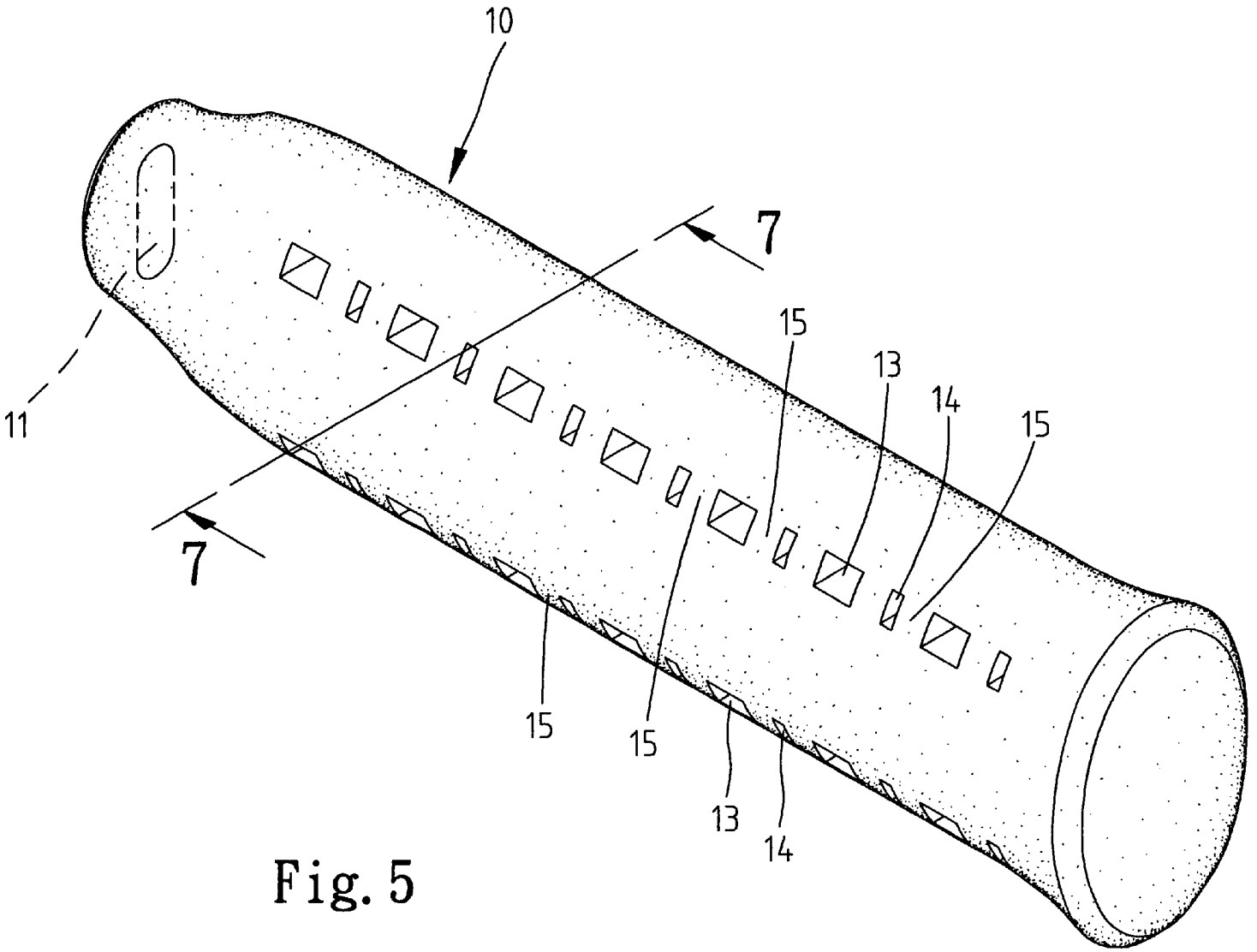
FIG. 5 is a perspective view of a second embodiment of the handle cover in accordance with the present invention.
Figure 6:
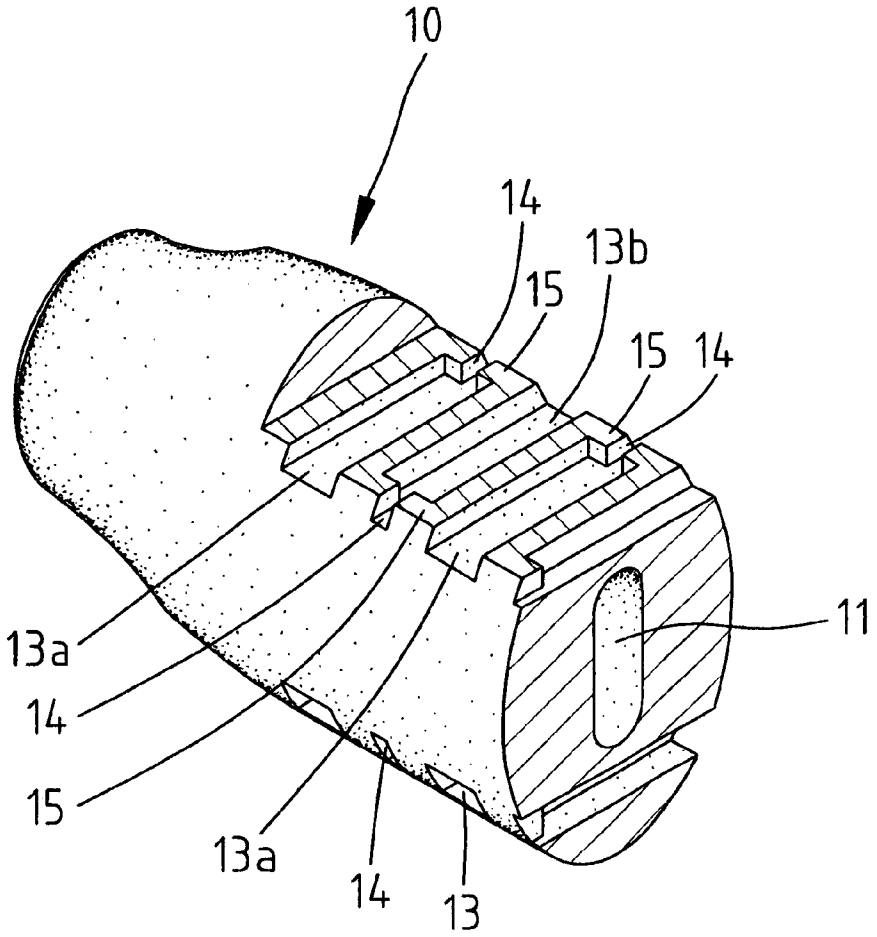
FIG. 6 is a perspective view, partly cutaway, of the handle cover in FIG. 5.
Figure 7:
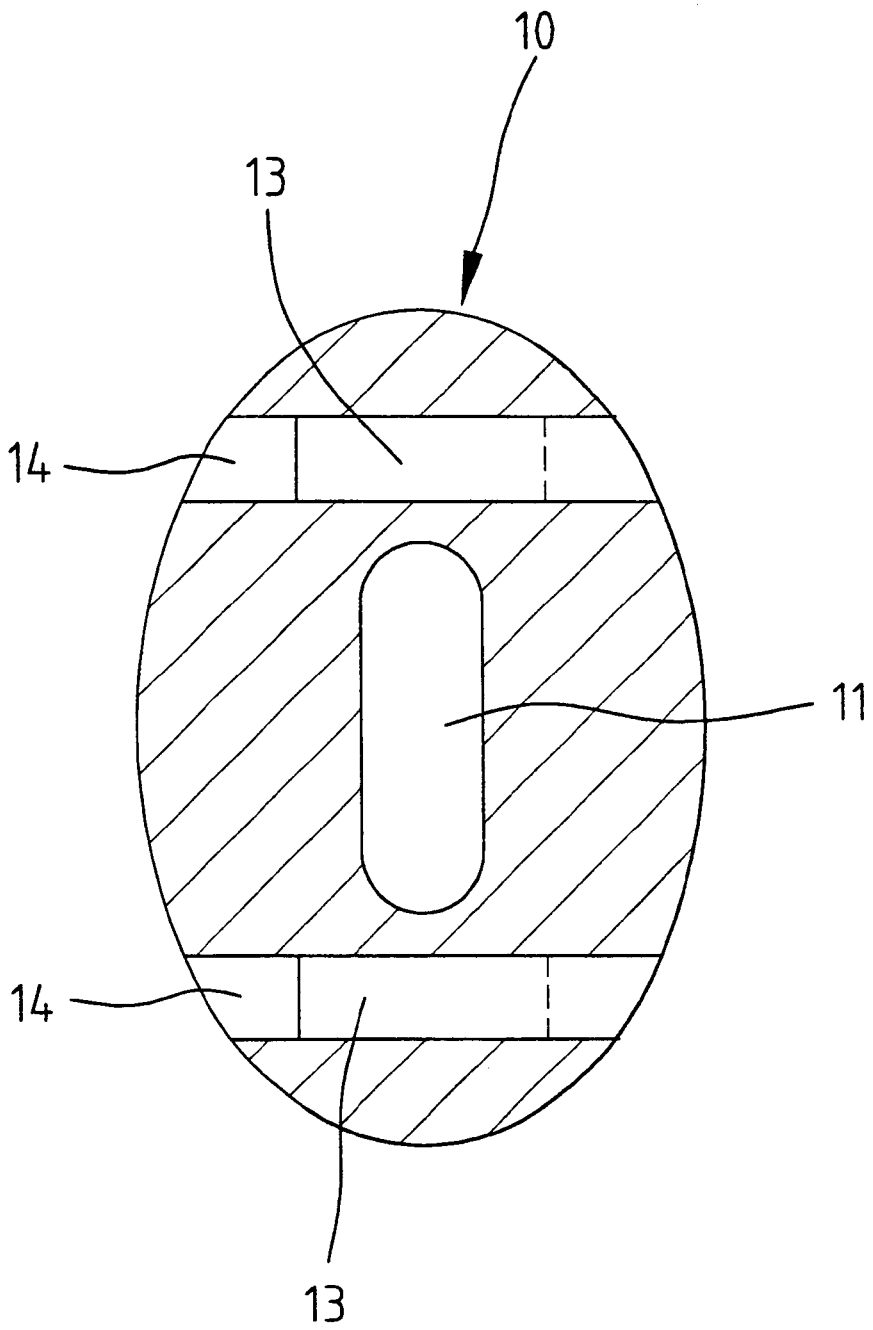
FIG. 7 is a sectional view taken along plane 7—7 in FIG. 5.

FIGS. 5 through 7 illustrate a second embodiment of the invention, wherein an end wall 15 delimiting each hole 13, 13*a*, 13*b* has a through-hole 14 that communicates the hole 13 with the environment. Thus, the air in each hole 13*a*, 13*b* can exit at a higher rate during a deforming procedure of the handle cover 10, and ambient air can enter each hole 13*a*, 13*b* at a higher rate during a shape-restoring procedure of the handle cover 10. This is because each hole 13*a*, 13*b* has two passageways (i.e., the opening 13*c*, 13*d* and the through-hole 14) for air. The vibration-absorbing capability is better, as the air may flow at a higher rate. The deformability of the end wall 15 of each hole 13, 13*a*, 13*b* is also increased. In conclusion, the vibration-absorbing capability and the anti-slip capability are both improved.

Figure 8:
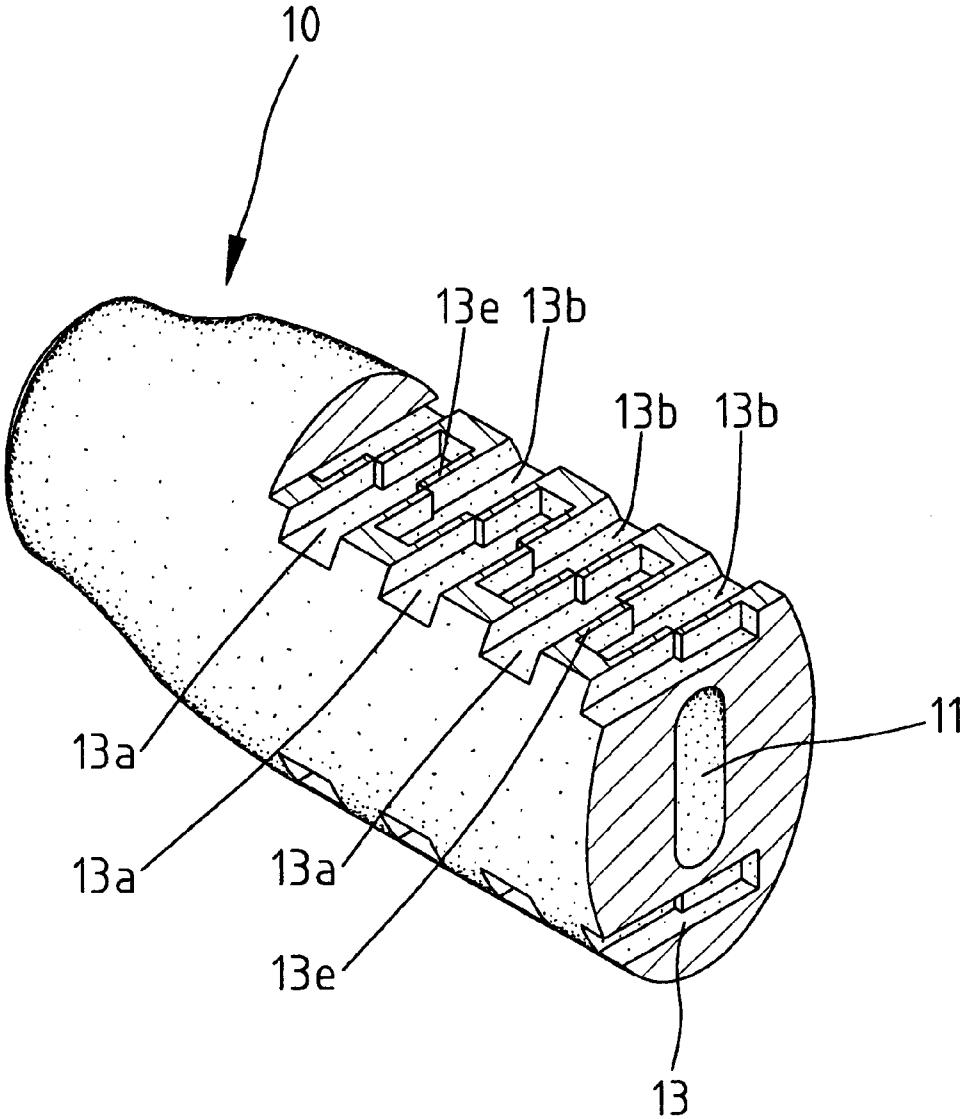
FIG. 8 is a perspective view, partly cutaway, of a third embodiment of the handle cover in accordance with the present invention.
Figure 9:
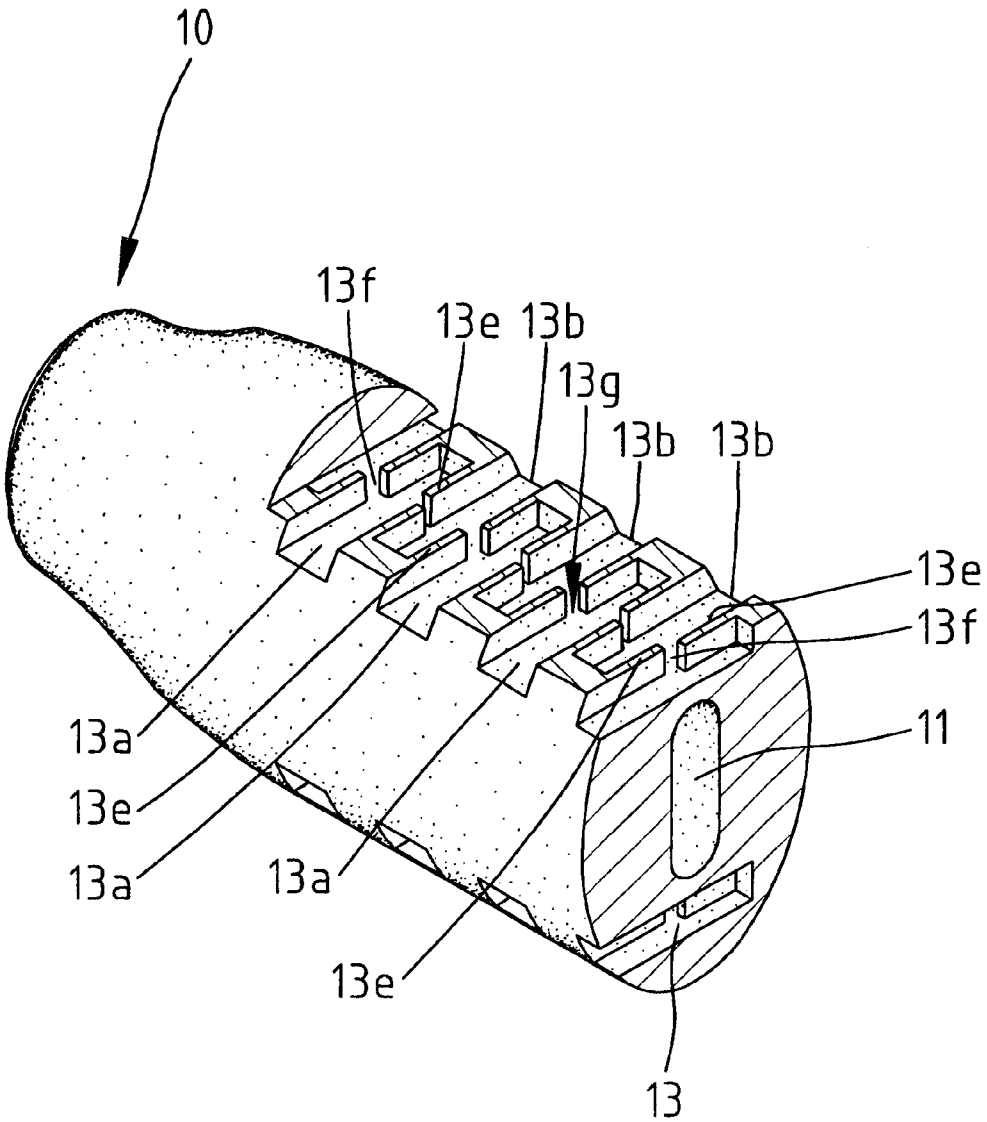
FIG. 9 is a perspective view, partly cutaway, of a fourth embodiment of the handle cover in accordance with the present invention.

FIG. 8 illustrates a third embodiment of the invention, wherein the separation walls 13*e* are arranged in a different manner. In particular, each hole 13, 13*a*, 13*b* has a stepped separation wall 13*e* formed by an associated one of the left mold and right mold mentioned above. FIG. 9 illustrates a fourth embodiment modified from the third embodiment, wherein each stepped separation wall 13*e* has a hole or passageway 13*f* that communicates one of two holes 13, 13*a*, 13*b* separated by the separation wall 13*e* with the other hole 13, 13*b*, leaving a central longitudinal channel 13*g*.

Figure 10:
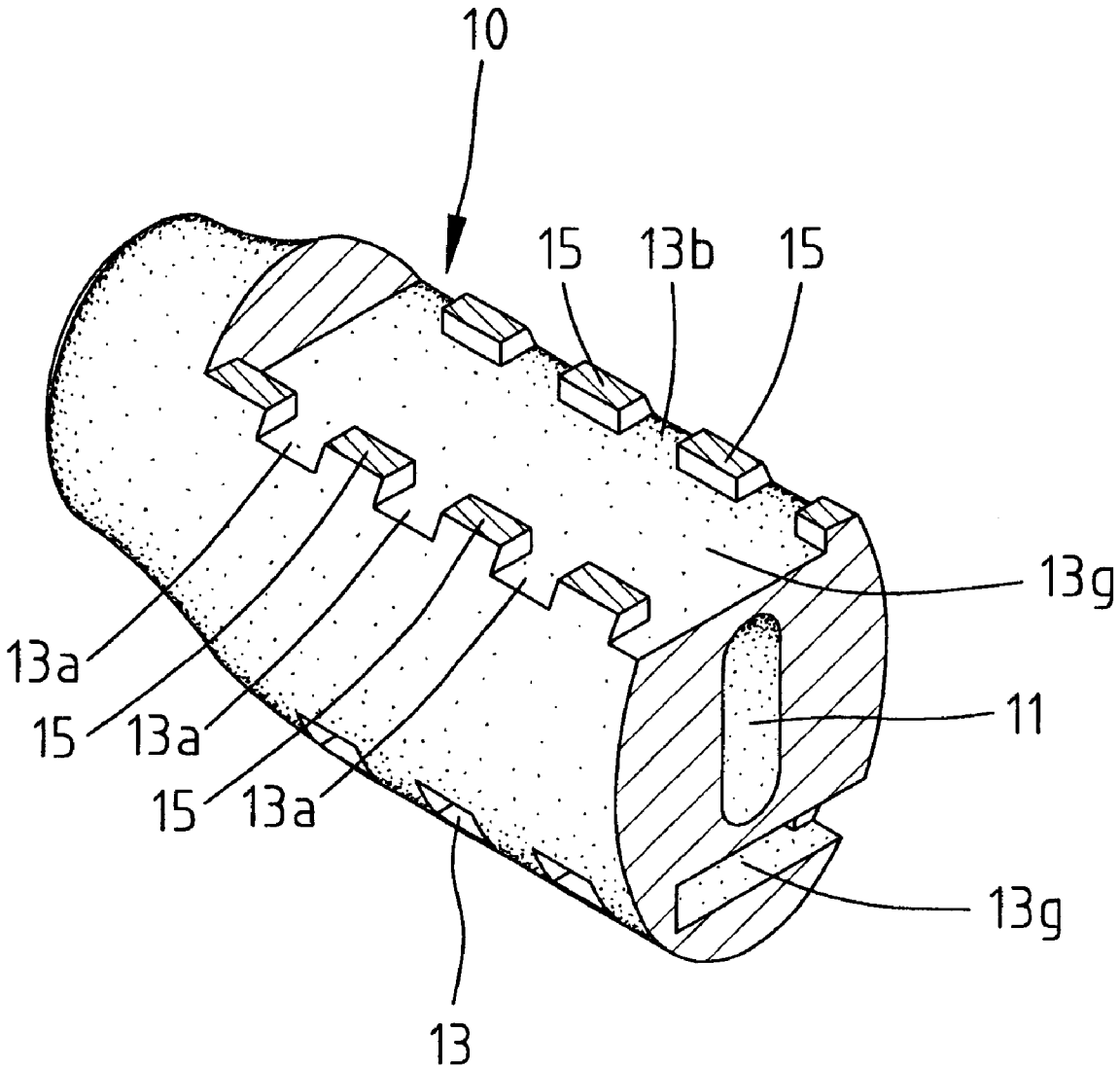
FIG. 10 is a perspective view, partly cutaway, of a fifth embodiment of the handle cover in accordance with the present invention.
Figure 11:
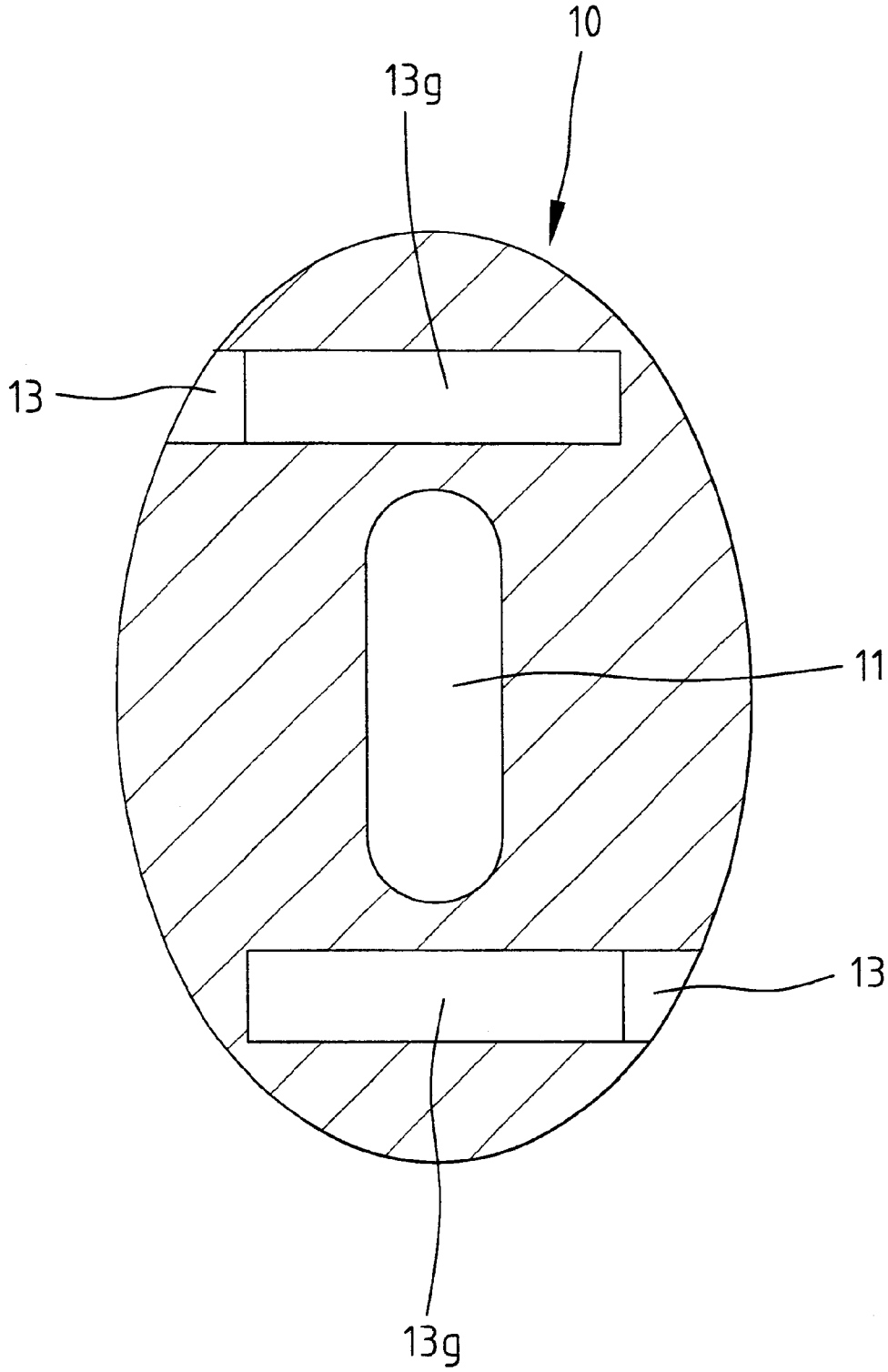
FIG. 11 is a sectional view of the handle cover in FIG. 10.

FIGS. 10 and 11 illustrate a fifth embodiment modified from the embodiment of FIG. 9, wherein the passageways

13*f* are larger, and the central longitudinal channel 13*g* is wider. Two ends of each longitudinal channel 13*g* are respectively delimited by two end walls and thus not communicated with outside, the user may firmly grip a rear end of the shock-absorbing handle cover 10 without the risk of slip during hammering, as the handle cover 10 would not be too soft to grip. Another advantage of the longitudinal channel 12 having two ends not communicated with outside is that the handle cover 10 can be manufactured in an easy, inexpensive way as mentioned above.

Figure 12:
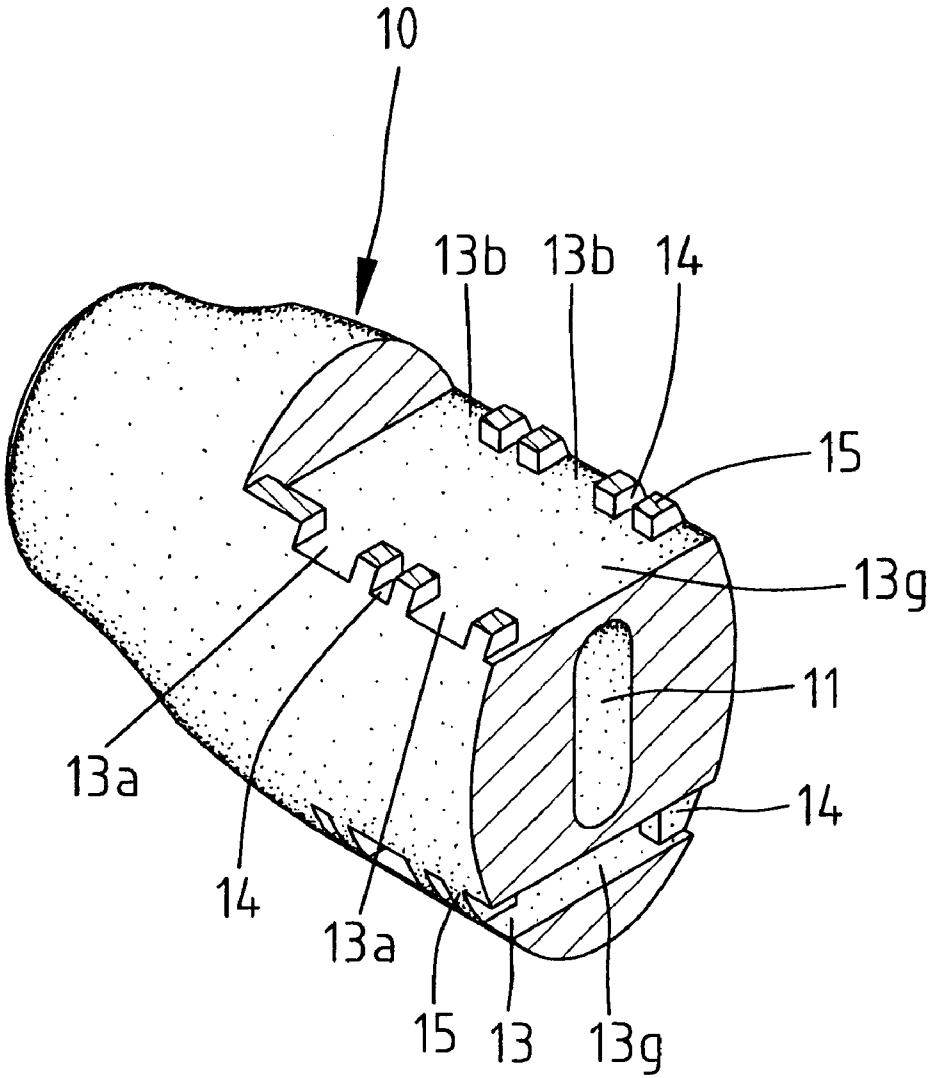
FIG. 12 is a perspective view, partly cutaway, of a sixth embodiment of the handle cover in accordance with the present invention.
Figure 13:
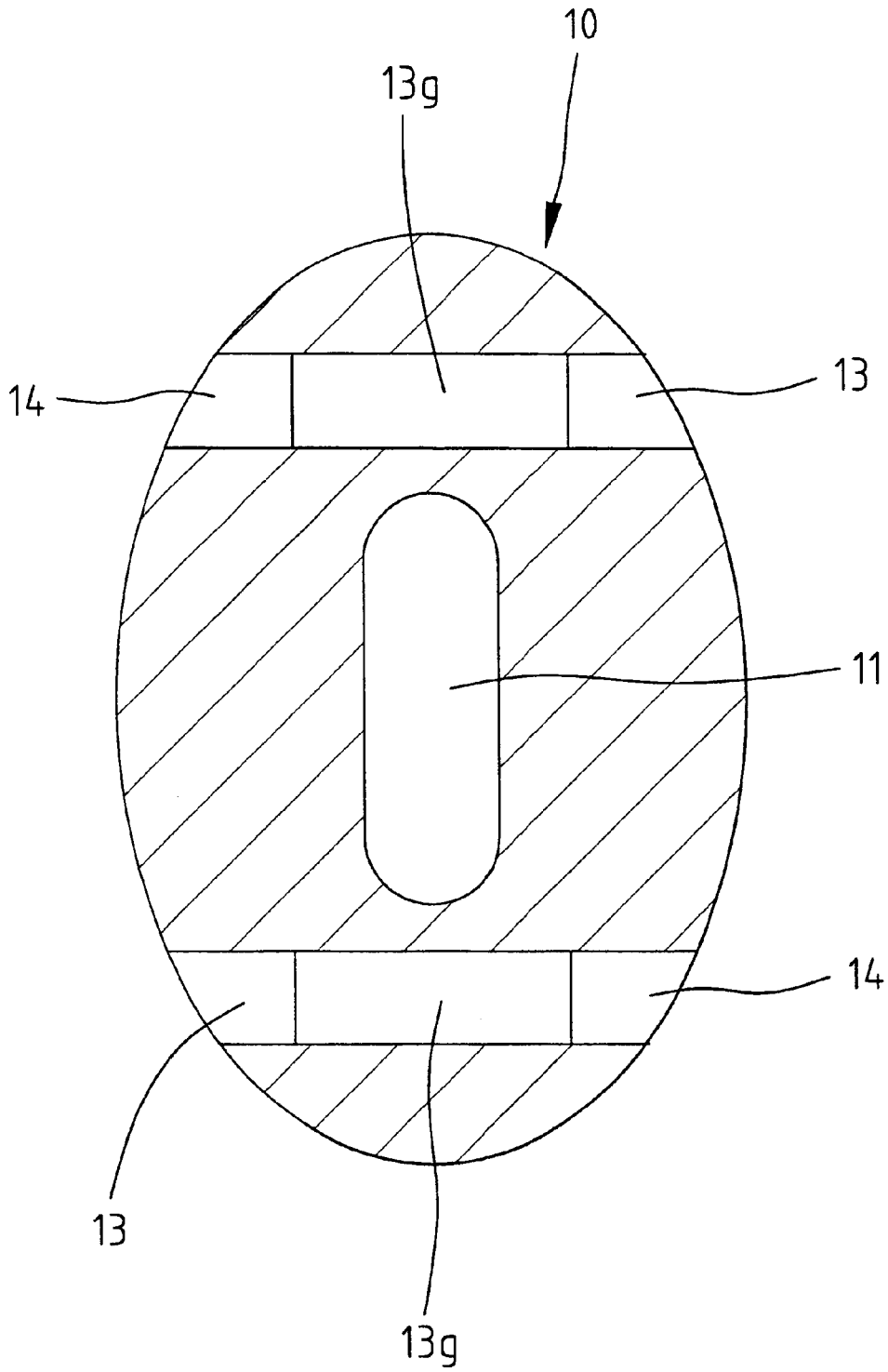
FIG. 13 is a sectional view of the handle cover in FIG. 12.
Figure 14:
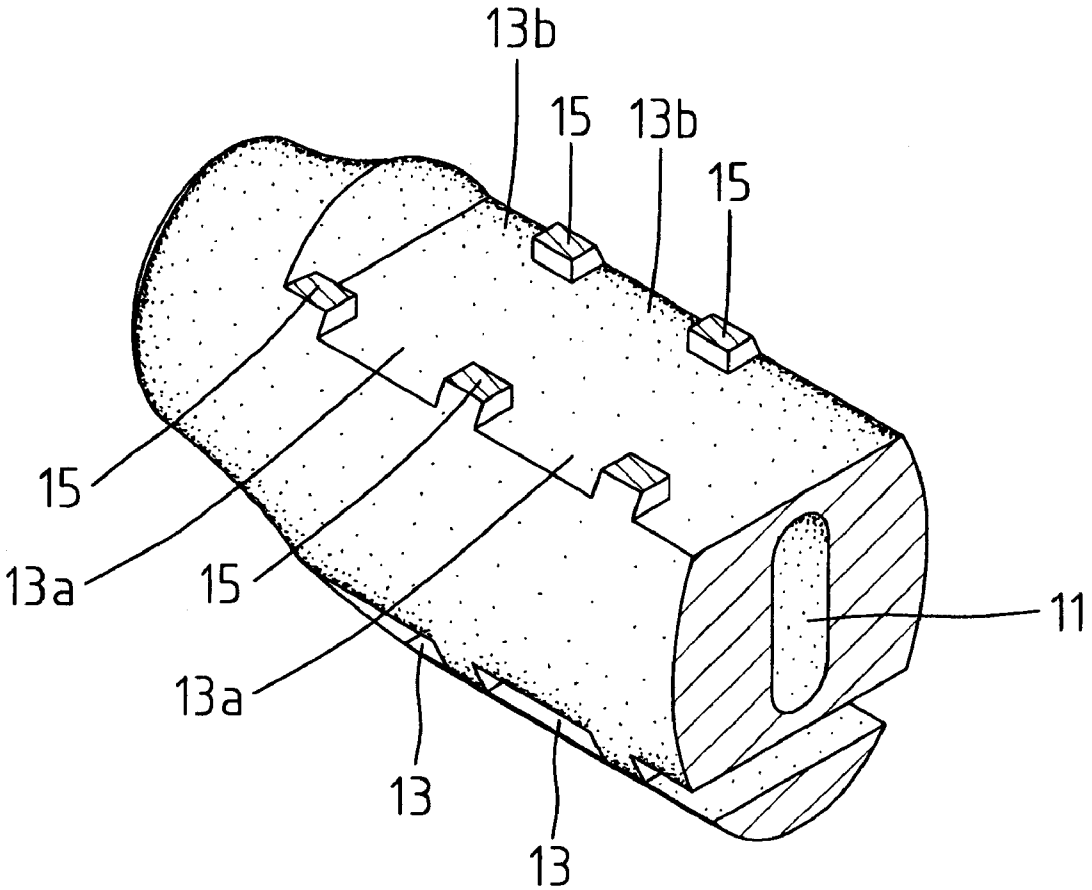
FIG. 14 is a perspective view, partly cutaway, of a seventh embodiment of the handle cover in accordance with the present invention.

FIGS. 12 and 13 illustrate a sixth embodiment modified from the embodiment of FIGS. 10 and 11, wherein the end wall 15 delimiting each hole 13, 13*a*, 13*b* has a through-hole 14 that communicates the hole 13 with the environment to allow rapid exit and entrance of air. FIG. 14 illustrates a seventh embodiment of the invention, wherein each first hole 13*a* is partially aligned with an associated second hole 13*b*, and the separation walls 13*e* are removed. The anti-slip function of the handle cover 10 is not affected, and the shock-absorbing capability is further improved, as the material for transmitting vibrations is further removed. It is noted that two ends of each longitudinal channel 13*g* are not communicated with outside.

According to the above description, the vibration-absorbing function of the handle cover 10 is improved by means of removing a part of the material for transmitting vibrations such that the remaining vibrations transmitted from the hammer to the user's hand through the handle cover 10 is harmless to the user's hand. Further, the left side of the upper portion of the handle cover 10 and the right side of the upper portion of the handle cover 10 are balanced in softness by means of alternately forming the first holes 13*a* and the second holes 13*b* along the longitudinal direction of the handle cover 10. The lower portion of the handle cover 10 has an identical arrangement.

Although the invention has been explained in relation to its preferred embodiment, it is to be understood that many other possible modifications and variations can be made without departing from the scope of the invention as hereinafter claimed.

What is claimed is:

1. A handle cover made of soft material and comprising:

a central longitudinal compartment adapted to receive a handle of a tool;

a plurality of first holes and a plurality of second holes defined in an upper portion of the handle cover, said first holes and said second holes being alternately disposed along a longitudinal direction of the handle cover with each said first hole extending in a direction transverse to the longitudinal direction of the handle cover and having an opening in a left side of the upper portion of the handle cover and with each said second hole extending in the direction transverse to the longitudinal direction of the handle cover and having an opening in a right side of the upper portion of the handle cover, each said first hole being delimited by a first end wall on the right side of the upper portion of the handle cover, each said second hole being delimited by a second end wall on the left side of the upper portion of the handle cover; and a plurality of third holes and a plurality of fourth holes defined in a lower portion of the handle cover, said third holes and said fourth holes being alternately disposed along the longitudinal direction of the handle cover with each said third hole extending in the direction transverse to the longitudinal direction of the handle cover and having an opening in a left side of the lower portion of the handle cover and with each said fourth hole extending in the direction transverse to the longitudinal direction of the handle cover and having an opening in a right side of the lower portion of the handle cover, each said third hole being delimited by a third end wall on the right side of the lower portion of the handle cover, each said fourth hole being delimited by a fourth end wall on the left side of the lower portion of the handle cover.

2. The handle cover as claimed in claim 1, wherein each said first hole and an associated one of said second holes adjacent thereto are separated by a separation wall.

3. The handle cover as claimed in claim 2, wherein each said separation wall has a passageway for communicating each said first hole and an associated one of said second holes adjacent thereto.

4. The handle cover as claimed in claim 2, wherein each said first end wall has a through-hole that communicates an associated one of said first holes with outside.

5. The handle cover as claimed in claim 2, wherein each said second first end wall has a through-hole that communicates an associated one of said second holes with outside.

6. The handle cover as claimed in claim 4, wherein each said second first end wall has a through-hole that communicates an associated one of said second holes with outside.

7. The handle cover as claimed in claim 2, wherein each said separation wall is stepped.

8. The handle cover as claimed in claim 1, wherein each said first hole is communicated with an associated one of said second holes adjacent thereto, leaving a longitudinal upper channel having two closed ends.

9. The handle cover as claimed in claim 8, wherein each said first hole is partially aligned with an associated one of said second holes adjacent thereto.

10. The handle cover as claimed in claim 8, wherein each said first end wall has a through-hole that communicates an associated one of said first holes with outside.

11. The handle cover as claimed in claim 8, wherein each said second end wall has a through-hole that communicates an associated one of said second holes with outside.

12. The handle cover as claimed in claim 1, wherein each said third hole and an associated one of said fourth holes adjacent thereto are separated by a separation wall.

13. The handle cover as claimed in claim 12, wherein each said separation wall has a passageway for communicating each said third hole and an associated one of said fourth holes adjacent thereto.

14. The handle cover as claimed in claim 12, wherein each said third end wall has a through-hole that communicates an associated one of said third holes with outside.

15. The handle cover as claimed in claim 12, wherein each said fourth end wall has a through-hole that communicates an associated one of said fourth holes with outside.

16. The handle cover as claimed in claim 12, wherein each said separation wall is stepped.

17. The handle cover as claimed in claim 1, wherein each said third hole is communicated with an associated one of said third holes adjacent thereto, leaving a longitudinal lower channel having two closed ends.

18. The handle cover as claimed in claim 17, wherein each said third hole is partially aligned with an associated one of said second holes adjacent thereto.

19. The handle cover as claimed in claim 17, wherein each said third end wall has a through-hole that communicates an associated one of said third holes with outside.

20. The handle cover as claimed in claim 17, wherein each said fourth end wall has a through-hole that communicates an associated one of said fourth holes with outside.

* * * * *